United States Patent [19]

Marks et al.

[11] Patent Number: 4,736,999

[45] Date of Patent: Apr. 12, 1988

[54] ELECTRICAL CONNECTOR WITH COMPONENT KEYING SYSTEM

[75] Inventors: Michael R. Marks, Trumbull; Alfred L. Ehrenfels, Cheshire, both of Conn.

[73] Assignee: Hubbell Incorporated, Orange, Conn.

[21] Appl. No.: 30,055

[22] Filed: Mar. 25, 1987

[51] Int. Cl.[4] ..... H01R 13/62

[52] U.S. Cl. ..... 439/314; 439/677; 439/680; 439/695; 439/218

[58] Field of Search ..... 439/701, 690, 674, 677, 439/680, 681, 752, 166, 170, 171, 173, 218, 221, 522, 518, 462, 695; 29/857, 747, 748

[56] References Cited

U.S. PATENT DOCUMENTS

| | | | |
|---|---|---|---|
| 3,725,845 | 4/1973 | Moulin | 439/677 |
| 3,818,420 | 6/1974 | Barr | 439/680 |
| 3,885,849 | 5/1975 | Bailey et al. | 439/518 |
| 4,053,198 | 10/1977 | Doyle et al. | 439/462 |
| 4,199,207 | 4/1980 | Lee | 439/674 |
| 4,229,064 | 10/1980 | Vetter et al. | 439/680 |

*Primary Examiner*—Gil Weidenfeld
*Assistant Examiner*—David Pirlot
*Attorney, Agent, or Firm*—Jerry M. Presson; Walter C. Farley

[57] ABSTRACT

A connector for high current use includes a plug half and a receptacle half. The plug half includes a sleeve which receives a blade holder and a contact holder. The sleeve is provided with notches having predetermined angular positions and widths. The blade and contact holders also include notches which are mated with those of the sleeve. A plurality of sleeves having a variety of notch widths and positions can be provided to define a selection of connectors for various electrical circumstances. Blade and contact holders with a variety of sets of key positions and widths are provided to match the sleeves and to have the necessary electrical characteristics.

11 Claims, 11 Drawing Sheets

FIG. 19.

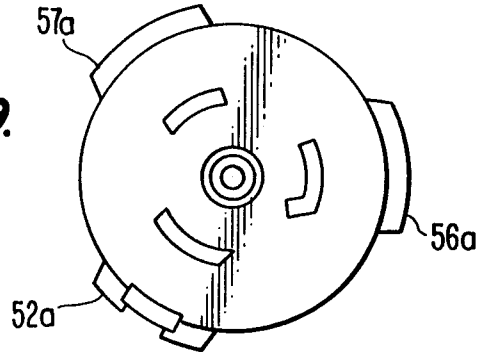

FIG. 20.

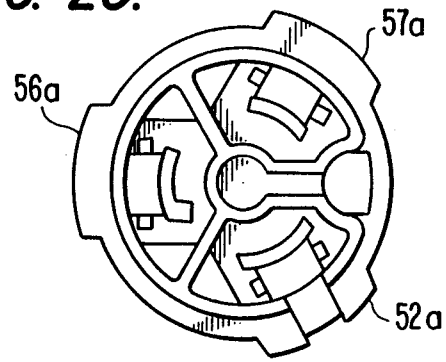

FIG. 21.

| EXAMPLE NO. | ELECTRICAL CHARACTERISTICS | (a) | (b) | (c) | (d) | (e) | NOTCH STYLE AT DATUM | | | BLADE OPENING AT DATUM | | | KEY STYLE AT DATUM | | |
|---|---|---|---|---|---|---|---|---|---|---|---|---|---|---|---|
| | | | | | | | -A- | -B- | -C- | -A- | -B- | -C- | -A- | -B- | -C- |
| 01 | 2P-3W-250V.D.C-600V.A.C | OMIT | OMIT | OMIT | OMIT | OMIT | FIG. 6. | FIG. 6. | FIG. 9. | d-2 | d-1 | d-3 | FIG. 14. | FIG. 14. | FIG. 14. |
| 02 | 2P-3W-250V.A.C. | 122 1/2° | 140° | 82 1/2° | 165° | OMIT | FIG. 6. | FIG. 6. | FIG. 10. | d-2 | d-1 | d-3 | FIG. 14. | FIG. 14. | FIG. 15. |
| 03 | 2P-3W-480V.A.C. | 122 1/2° | 140° | 82 1/2° | 165° | OMIT | FIG. 6. | FIG. 6. | FIG. 11. | d-4 | d-1 | d-3 | FIG. 14. | FIG. 14. | FIG. 16. |
| 04 | 2P-3W-125 V.A.C. | 47 1/2° | 165° | 82 1/2° | 165° | OMIT | FIG. 6. | FIG. 7. | FIG. 12. | d-1 | d-1 | d-1 | FIG. 14. | FIG. 15 | FIG. 16. |
| 05 | 3P-4W-250 V.A.C.-600V.A.C. | OMIT | OMIT | OMIT | OMIT | 0° | FIG. 6. | FIG. 8. | FIG. 8. | d-1 | d-1 | d-1 | FIG. 14. | FIG. 16 | FIG. 16. |
| 06 | 3P-4W-125/250 V.A.C. | 47 1/2° | 165° | 82 1/2° | 165° | 20° | FIG. 7. | FIG. 7. | FIG. 10. | d-2 | d-2 | d-1 | FIG. 15. | FIG. 15. | FIG. 15. |
| 07 | 3P-4W-480V.3Ø | 122 1/2° | 140° | 82 1/2° | 165° | 20° | FIG. 8. | FIG. 8. | FIG. 9. | d-2 | d-2 | d-1 | FIG. 16. | FIG. 16. | FIG. 14. |
| 08 | 3P-4W-250V.3Ø | 47 1/2° | 165° | 82 1/2° | 165° | 20° | FIG. 8. | FIG. 8. | FIG. 10 | d-4 | d-4 | d-1 | FIG. 16. | FIG. 16. | FIG. 15. |

ELECTRICAL CONNECTOR WITH COMPONENT KEYING SYSTEM

CROSS REFERENCE TO RELATED APPLICATION

This invention is related to an apparatus disclosed in our copending commonly assigned application entitled Latch and Retainer Mechanism for Electrical Connector, Ser. No. 029,945, filed concurrently herewith, the content of which is hereby incorporated by reference.

This invention relates to a family of improved high-current electrical connectors having a key system for preventing incorrect assembly of components selected from a variety of such components.

BACKGROUND OF THE INVENTION

Electrical connectors which are designed for high current applications are made in a variety of configurations so that a male plug designed for one type of use will not be matable with a female receptacle intended for a significantly different use. For example, it should be physically impossible to connect a plug designed and approved for 125 volt use with a receptacle designed for use with, and possibly connected to, a 480 volt source. In the connectors known as locking connectors, which involve axial joining followed by a rotational locking movement, the blades of such connectors are necessarily on circular paths concentric with the centers of the connector halves.

A dominant line of connectors designed to satisfy these basic requirements and other safety and operating requirements has been on the market for several years. These connectors use several distinct blade designs in conjunction with a selection of arrangements of bumps and grooves on the mating connector parts to assure that the male and female connector halves cannot be joined unless they are specifically intended to be.

While the various permutations of these arrangements has performed their tasks well, the successful use of the connector portions also depends upon proper assembly of the components which form the connector halves and proper wiring of the connectors in the field. It has been customary to rely upon the skill and care of individuals involved in these steps but that has proved not always to be adequate and, in addition, the assembly of the connector halves has become quite expensive.

It has therefore become important to have a set of connectors which are compatible with the previously used connectors of the same types, for replacement purposes, but which are more economical to assembly and in which the components are reliably and unmistakably assembled in their proper relationships.

SUMMARY OF THE INVENTION

Accordingly, an object of the present invention is to provide a structural arrangement in which a variety of connector components are uniquely formed so that they can be assembled easily to form several different configurations of connector halves which are usable under predetermined electrical conditions.

A further object is to provide such connectors halves which are compatible with connectors previously used under the same electrical conditions.

Another object is to provide such connectors halves which have improved safety and electrical characteristics.

Briefly described, the invention includes an electrical connector of the type having a male half and a female half which are joinable by successive axial and rotational movements, the male half having a plurality of axially protruding blades at least partially enclosed by a sleeve and the female half having a barrel receivable in one end of the sleeve with a plurality of openings with contact means positioned to receive the blades. In the improved connector, the male half comprises a blade holding body of insulating material receivable in the other end of the sleeve, the blade holding body having a plurality of radially protruding key members of selected widths and in selected angular positions, the blades extending through the blade holding body and protruding from opposite ends thereof. A contact holding body is also receivable in the other end of the sleeve adjacent the blade holding body and has contact means therein for connecting wires entering the connector to one end of each of the blades, the contact holding body having a plurality of radially protruding key members of selected widths and in selected angular positions. The sleeve, which is in the form of a tubular cylindrical body, receives the female connector barrel at one end during joining of the connectors and receives and retains the blade and contact holding bodies at the other end. The sleeve has a plurality of notches extending axially into the sleeve from said other end, the notches being angularly positioned and dimensioned to receive the key members of only those blade and contact holding bodies having key members in selected predetermined positions, thereby permitting assembly into a connector of only those connector components having corresponding electrical characteristics.

In another aspect, the invention includes a plurality of components for making connectors of a plurality of classes, each connector class including connectors having predetermined electrical characteristics different from each other class, each connector being of the type having a male half and a female half which are joinable to electrically interconnect conductive members in the halves, the male half having a plurality of axially protruding blades at least partially enclosed by a sleeve and the female half having a barrel receivable in one end of the sleeve with a plurality of openings with contact means positioned to receive the blades. The components include a plurality of blade holding bodies of insulating material, each such body including a plurality of radially protruding key members, each having a width and an angular position selected from a predetermined number of sets of widths and angular positions, the combination of sets on each body being unique to a class of connectors. The plurality of blades extends through each blade holding body and protrudes from opposite ends thereof. A plurality of contact holding bodies each has contact means therein for connecting wires entering the connector to one end of each of the blades, each contact holding body also having a plurality of radially protruding key members each having a width and an angular position selected from a predetermined number of sets of widths and angular positions, the combination of sets on each body being unique to a class of connectors. The components further include a plurality of sleeves each of which includes a tubular cylindrical body for receiving the barrel at one end during joining of the connector halves and for receiving and retaining one each of the blade and contact holding bodies at the other end. Each sleeve has means defining a plurality of notches extending axially into the sleeve from said other end, the notches being angularly positioned and dimensioned to receive blade and contact holding bodies having key members in unique combinations of sets of positions and widths so that the bodies and sleeves can be assembled to form a plurality of connectors each of which has the proper components for a predetermined connector class.

In yet another aspect, the invention includes a method of forming components for making connectors of a plurality of connector classes, each class including connectors having predetermined electrical characteristics different from each other class, each connector being of the type having a male half and a female half which are joinable to electrically interconnect conductive members in the halves, the male half having a plurality of axially protruding blades at least partially enclosed by a sleeve and the female half having a barrel receivable in one end of the sleeve with a plurality of openings with contact positioned to receive the blades. The method includes forming a plurality of blade holding bodies of insulating material in which each blade holding body includes a plurality of radially protruding key members each having a width and an angular position selected form a predetermined number of sets of widths and angular positions, the combination of sets on each body being unique to a class of connectors, and a plurality of blades extending through the blade holding body and protruding from opposite ends thereof. A plurality of contact holding bodies are formed, each such body having contact means therein for connecting wires entering the connector to one end of each of the blades, each contact holding body having a plurality of radially protruding key members each having a width and an angular position selected from a predetermined number of sets of widths and angular positions, the combination of sets on each body being unique to a class of connectors. Finally, the method includes forming a plurality of sleeves each including a tubular cylindrical body for receiving a barrel at one end during joining of the connector halves and for receiving and retaining one each of the blade and contact holding bodies at the other end, each sleeve being formed with a plurality of notches extending axially into the sleeve from the other end, the notches in each sleeve being angularly positioned and dimensioned to receive blade and contact holding bodies having key members in a unique combination of sets of positions and widths so that the bodies and sleeves can be assembled to form a plurality of connectors each of which has the proper components for a predetermined connector class.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification and wherein:

FIGS. 19 and 20 are front and rear end elevations, respectively, of a blade holder for a three-wire connector showing a further example of a blade configuration and key form arrangement;

FIG. 21 is a chart of keying elements used to form a set of several combinations for various specific sets of electrical conditions;

DESCRIPTION OF THE PREFERRED EMBODIMENTS

Figure 1:
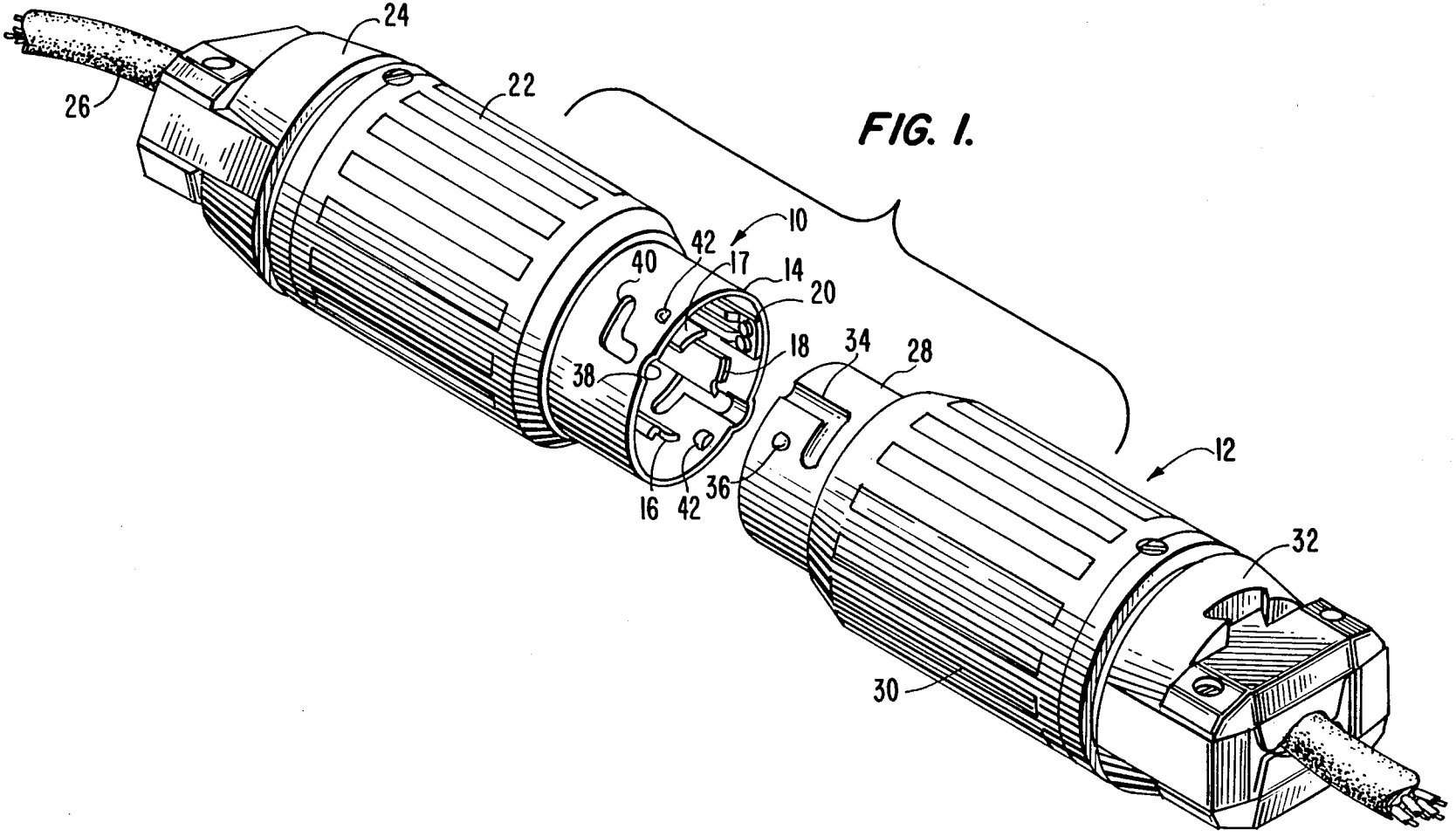
FIG. 1 is a perspective view of the two halves of a connector in accordance with the invention, positioned to be joined.

FIG. 1 shows a connector in accordance with the invention with the two halves of the connector separated and in a position about to be joined. The connector includes a male or plug half indicated generally at 10 and the female or receptacle half indicated generally at 12. Plug 10 includes a sleeve 14 which is a tubular metal body surrounding blades 16, 17 and 18. A grounding strap 20 is riveted to the inner surface of shell 14 in position to engage a grounding strap on the receptacle. A front housing 22 which is made of an insulating material partly surrounds shell 14 and threadedly engages a rear housing 24 which has a cable clamp to grip a cable 26 carrying wires into the interior of the housings.

The female, receptacle, half 12 includes a barrel 28 which is made of an insulating material and is dimensions to be received in one end of sleeve 14. Barrel 28 is provided with openings, not visible in FIG. 1, to receive blades 16–18. A front housing 30, similar to housing 22, partially surrounds the barrel and threadedly engages a rear housing 32 which is substantially identical to rear housing 24 and which also includes a cable clamp arrangement to engage a cable entering the receptacle portion of the connector.

The external surface of barrel 28 is provided with a generally L-shaped groove and also has a protrusion or bump 36. Shell 14 is provided with a recess 38 on the inner surface of the distal edge of shell 14 which leads into an L-shaped opening 40 to receive bump 36. An inward protrusion 42 is provided on shell 14 to enter recess 34. A similar set of recesses, bumps and protrusions is found on the opposite side of both the barrel and sleeve, the sets being separated by angles which require a unique angular relationship between the halves for them to be joined.

As will be recognized, these bumps and recesses are designed to, first, allow the connector halves to be joined in only one rotational relationship and, secondly, the allow the axial and rotational movement which is used to join these connectors since they are a form of connector which requires a twisting motion in order to lock them together. Finally, the grooves and protrusions perform part of the locking function. Bump 36 passes through recess 38 and enters opening 40 and, after the twisting motion, prevents separation of the connector halves by direct axial movement. Counter rotation is required. While this portion of the structure is not per se new, it is important to recognize that connector halves designed to be compatible with rotationally locking connectors of the prior art must include not only the grooves, recesses and bumps which will permit the rotation and locking action but, in addition, such a connector must have blades and blade receiving openings arranged in such a way that the blade can enter the openings with axial movement followed by rotational movement to perform the locking function.

Figure 2:
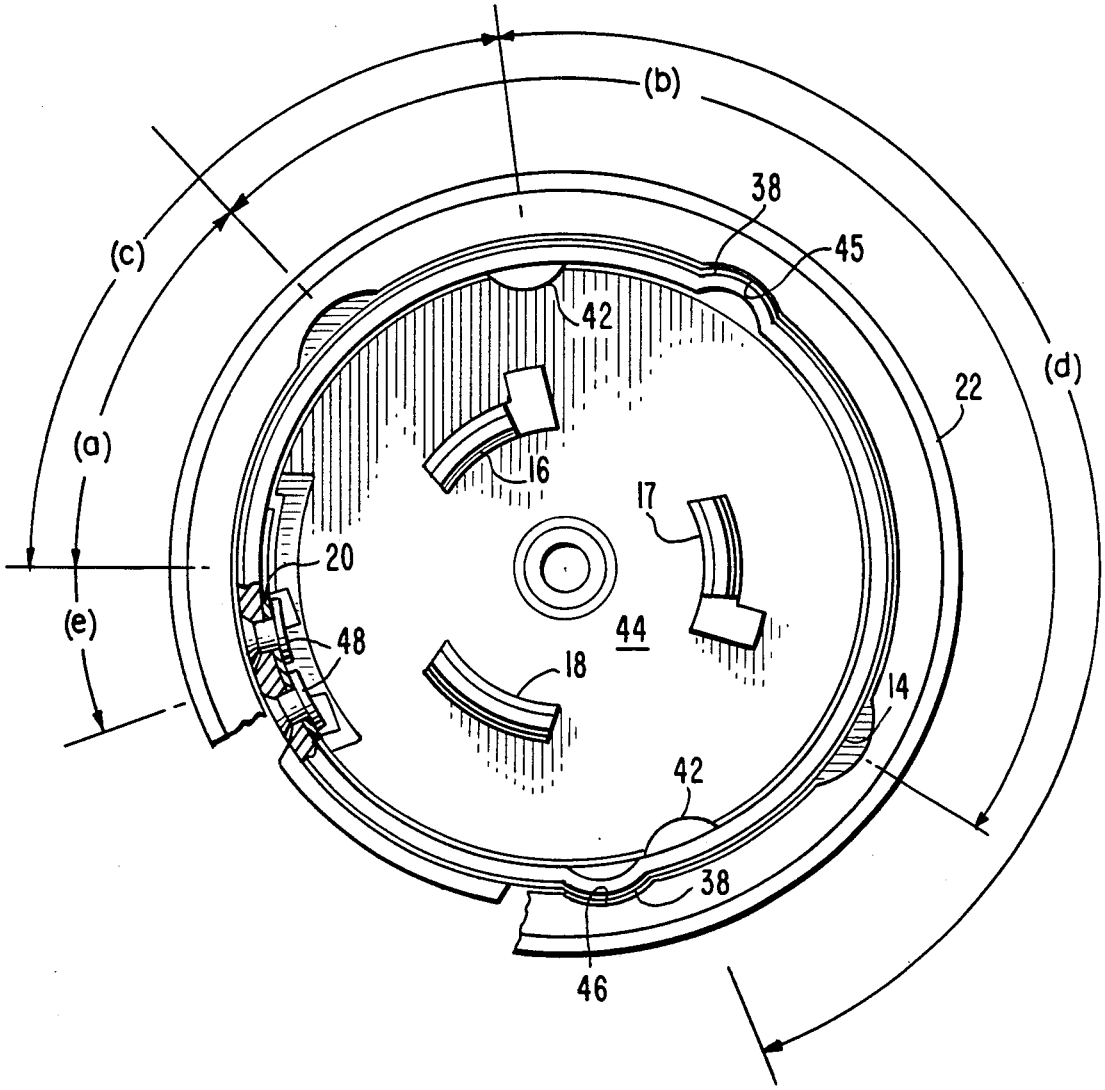
FIG. 2 is a front end elevation of the male (plug) half of an embodiment of the connector of FIG. 1 for use in four-wire circuits.

FIG. 2 is an end view of the plug of FIG. 1 showing blades 16, 17 and 18 and also showing in more detail the shape of sleeve 14 and various other features. The blades are held in a blade holder 44 which is a body of electrically non-conductive polymeric material which is generally cylindrical in shape and which will be described in somewhat greater detail in connection with the keying functions of the connector components. It will be observed that the inward and outward protrusions 42 and 38 on sleeve 14 are offset angularly from each other in such a way that a special angular orientation of front housing 22 is necessary in order for proper assembly and also for mating with the receptacle. The front housing is assembled onto sleeve 14 by inserting it over the open, blade-enclosing end of the sleeve with its recesses 45 and 46 aligned with protrusions 38. As the front housing is moved further onto the sleeve assembled with other components, its rotational orientation is maintained by cooperation with the other keying elements which will be explained.

FIG. 2 also illustrates the mounting of grounding strap 20 to sleeve 14, this portion being shown in section. The mounting strap is attached to the sleeve by rivets 48 which pass through the grounding strap and the shell. The outer ends of the rivets are smoothed so that they do not protrude beyond the outer surface of the sleeve. The inner heads of rivets 48 form contacts which slide against a mating grounding strap on the receptacle barrel. The strap extends along the outside of blade holder 44 and protrudes beyond its other end.

Figure 3:
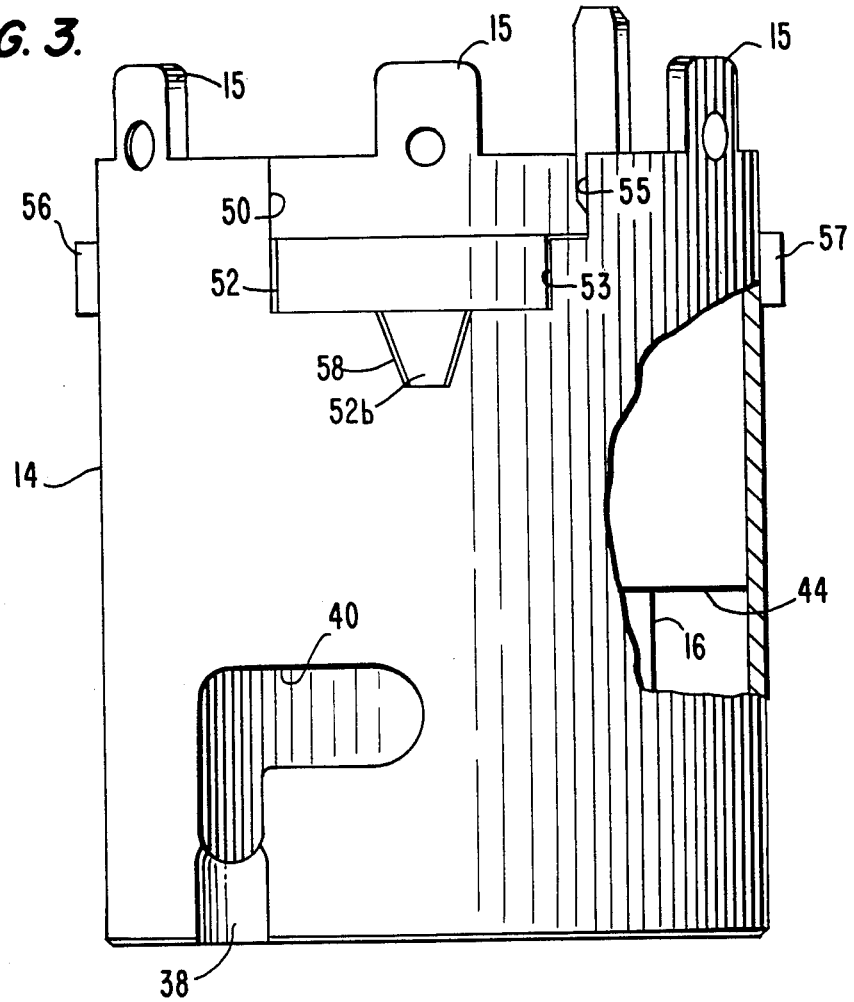
FIG. 3 is a side elevation of a portion of the connector half of FIG. 2.

FIG. 3 shows a side elevation of sleeve 14, partly cut away, with a blade holder 44 inserted in the sleeve, the blade holder having a single blade 16 mounted therein. Sleeve 14 is provided with an axially inwardly extending recess 50 forming a notch to receive a radial protrusion 52 formed on the blade holder body. As seen in FIG. 3, the axial depth of notch 50 is somewhat greater than the axial thickness of radial protrusion 52. The notch can be viewed as having two portions, a lower portion 53 and an upper portion 55, the portions being of selectable width and angular position. Actually, portions 53 and 55 can be the same width and therefore visually indistinguishable. However, because of the depth, it is possible to receive a radial protrusion from a blade holder and also on a contact holder which will be inserted on top of the blade holder. Sleeve 14 also has axially projecting tabs which are used to retain blade holder and contact holder bodies in the sleeve as will be described.

Figure 4:
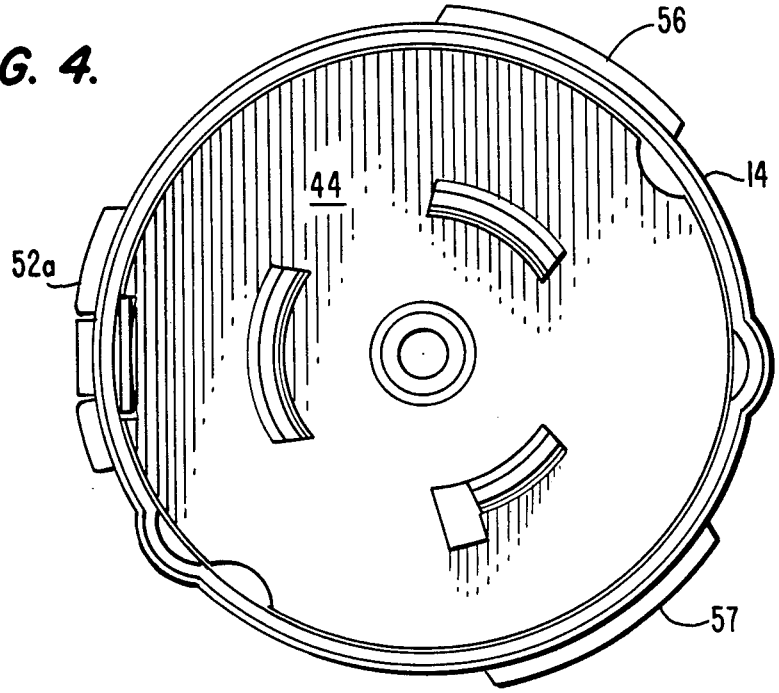
FIG. 4 is a front end elevation of the male (plug) half of an embodiment of the connector for use in three-wire circuits.
Figure 5:
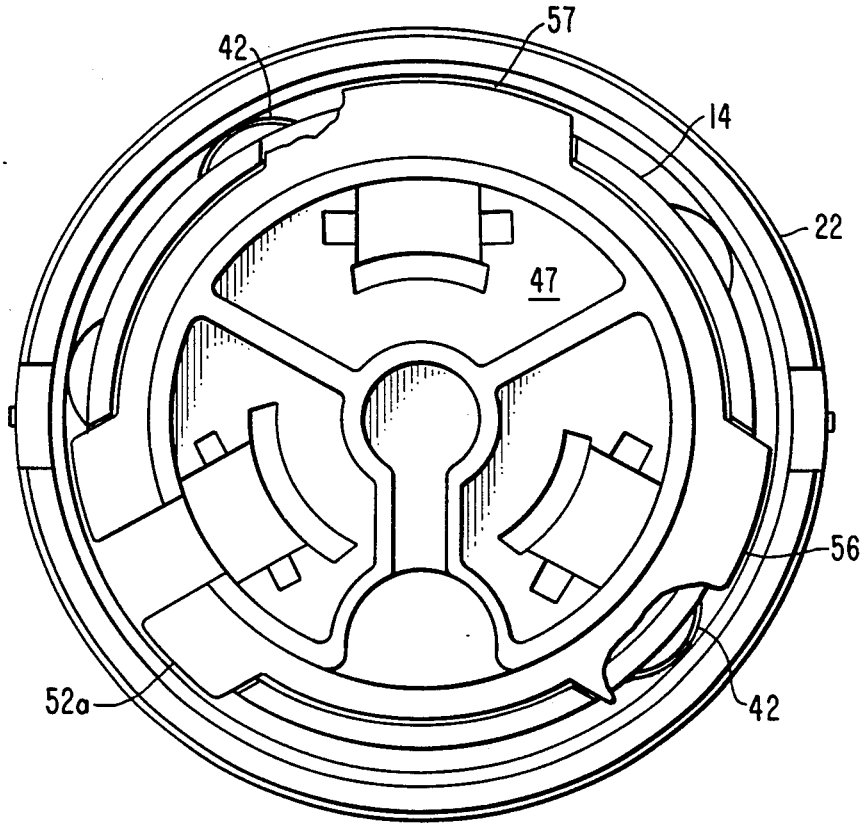
FIG. 5 is a rear end elevation of the front portion of the connector of FIG. 2.
Figure 9:
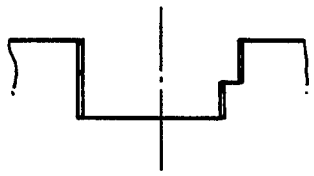
FIGS. 6–13 are partial side elevations of the sleeve portions of the connectors of FIGS. 1–5 showing a variety of notch shapes usable in the keying system of the present invention.
Figure 8:
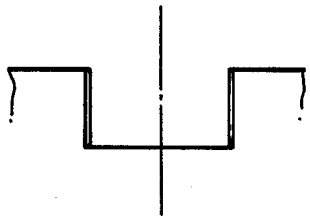
Figure 7:
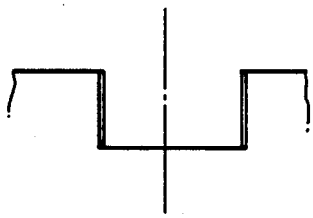
Figure 6:
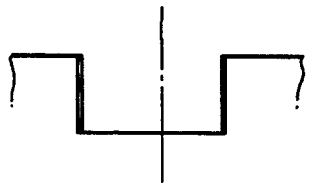
Figure 13:
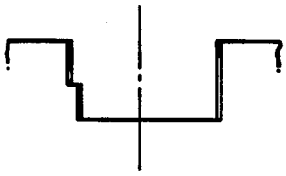
Figure 12:
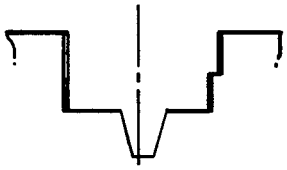
Figure 11:
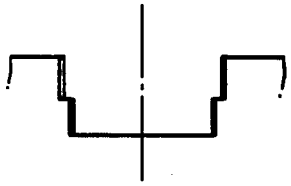
Figure 10:
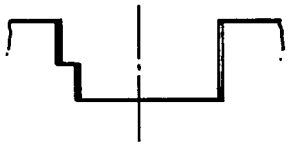

FIG. 4 shows a blade holder 44 mounted in a sleeve 14, the blade holder having a radial protrusion **52*a* and also radial protrusions 56 and 57. Sleeve 14 is provided with notches for protrusions 56 and 57 all of which can be varied as to width and angular position depending upon the blade holder and contact holder with which it is to be used. Thus, protruding members 52, 56 and 57 establish the rotational orientation of the blade holder with respect to the sleeve and it is necessary for them to be in the proper angular positions and to have the proper widths to enter their respective notches in order for the blade holder to be insertable to its proper position as shown in FIG. 3**.

FIGS. 6–13 illustrate various practical notch styles which are used to receive various forms of protrusions on the blade holder and contact holder bodies so that the protrusions act as keys and determine whether or not any set of components can be assembled together. It will be observed in each of FIGS. 6–13 that the angular position of each notch is referenced to a center line which can be thought of as a fixed radial plane bisecting the largest angle between the center lines of the other two notches in the sleeve. If this center plane is regarded as being fixed, then it will be seen that the available notch positions can be viewed as shifting from one side to the other and, in addition, of having two levels with which to work.

FIG. 3 also shows an additional key recess 58 which is provided in only one of the notches to establish one of the center lines. A projection **52*b* extends down from protrusion 52** to enter that recess, thus providing a third level. This also facilitates assembly by providing a readily apparent, visually obvious, reference key.

Figure 16:
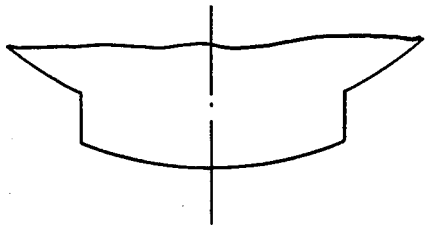
FIGS. 14–16 are rear end views of key forms usable with the notch shapes of FIGS. 6–14.
Figure 15:
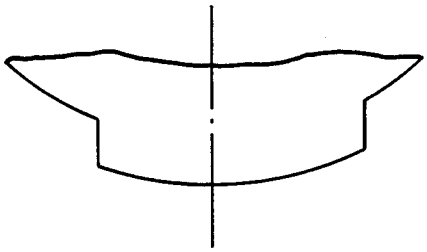
Figure 14:
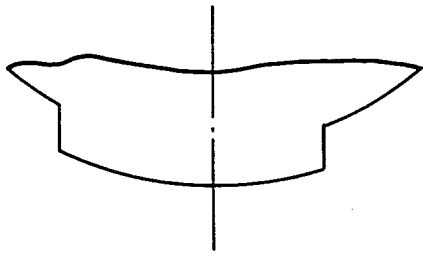

FIGS. 14, 15 and 16 illustrate three key styles which can be used for any one of the radial protrusions on the blade holding body or the contact holding body, allowing various permutations to be provided.

Figure 18:
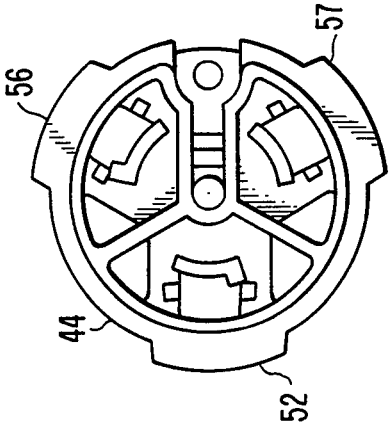
FIGS. 17 and 18 are front and rear end elevations, respectively, of a blade holder for a four-wire connector showing an example of a blade configuration and key form arrangement.
Figure 17:
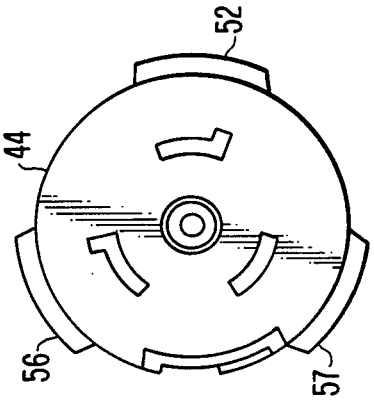

FIGS. 17, 18, 19 and 20 show two of the variations which can be achieved in a blade holding body. the front view and the rear view, respectively, of FIGS. 17 and 18 show a blade holding body having a key 52 which is of the type shown in FIG. 15, each of FIGS. 14–16 being viewed as from the rear of the blade holder. Key 56 in FIGS. 17 and 18 is also of the type shown in FIG. 15. However, key 57 is of the type shown in FIG. 14. Thus, the blade holder of FIGS. 17 and 18 could only be assembled with a sleeve having notches with widths and angular positions suitable to receive the keys of the forms described. The blade holder of FIGS. 19 and 20, which is of a type similar to that shown in FIG. 4 has a key **52*a* of the type shown in FIG. 16. However, keys 56*a* and 57*a* are of the type shown in FIG. 14**.

Using these notch styles, and the associated key styles, it will be readily apparent that a variety of permutations are possible and that a selection of sleeves and blade holding bodies can be produced which can only be assembled in specific sets wherein the sets have particular combinations of key and notch arrangements.

FIG. 21 is a tabulation of eight examples of permutations of the various characteristics of the components discussed above. The first column of the table simply assigns numbers to these examples. The second column identifies the typical characteristics, including voltage rating, which are to be satisfied by the connectors of each example. Example #1 is a connector for a two pole, three wire circuit usable with 250 volts DC or 600 volts AC.

The next five columns identify the angular positions of the bumps and recesses which are formed in shell 14, on the interior of front housing 22, on barrel 28 of the female receptacle and unhousing 30. It will be observed that not every connector has all of the bumps and that on the other connectors they are located at different angular positions. The angles referred to in the table of FIG. 21 are illustrated in FIG. 2.

The next three columns identify the notch styles which are formed in the end of sleeve 14 to receive the keys. The notches are formed at three datum locations A, B and C which are separated by 120°. The notches which are used at each of these locations are chosen from the styles illustrated in FIGS. 6–13.

The next three columns identify the blade openings in the blade holder which is to be used in a specific connector. Four different blade opening shapes, and therefore blade shapes, are employed in the connectors described herein. These are identified by the numbers d-1 through d-4, examples of these blade opening shapes being seen in FIGS. 17 and 19. Two of the blade opening shapes d-1 and d-3 are arcuate openings of different lengths. Opening d-2 is somewhat L-shaped having an arcuate portion with an outward protrusion at one end. Two of these are seen, along with a d-1 opening, in FIG. 17. The d-4 opening is an arcuate opening with an inwardly extending portion at one end. This is seen in FIG. 19 along with the d-1 and d-3 openings.

Finally, the last three columns identify the key styles which are to be used at the respective datum lines, these styles being selected from those shown in FIGS. 14–16.

As will be recognized, various other permutations can be chosen, depending upon the combination of elements which are necessary to form a connector having specified electrical and mechanical characteristics. By forming the blade holder and contact holder with keys in certain positions and having certain angular widths and by forming sleeves with notches of the selected sizes, the components can be assembled in only one way to form the connectors having the selected characteristics.

Figure 22:
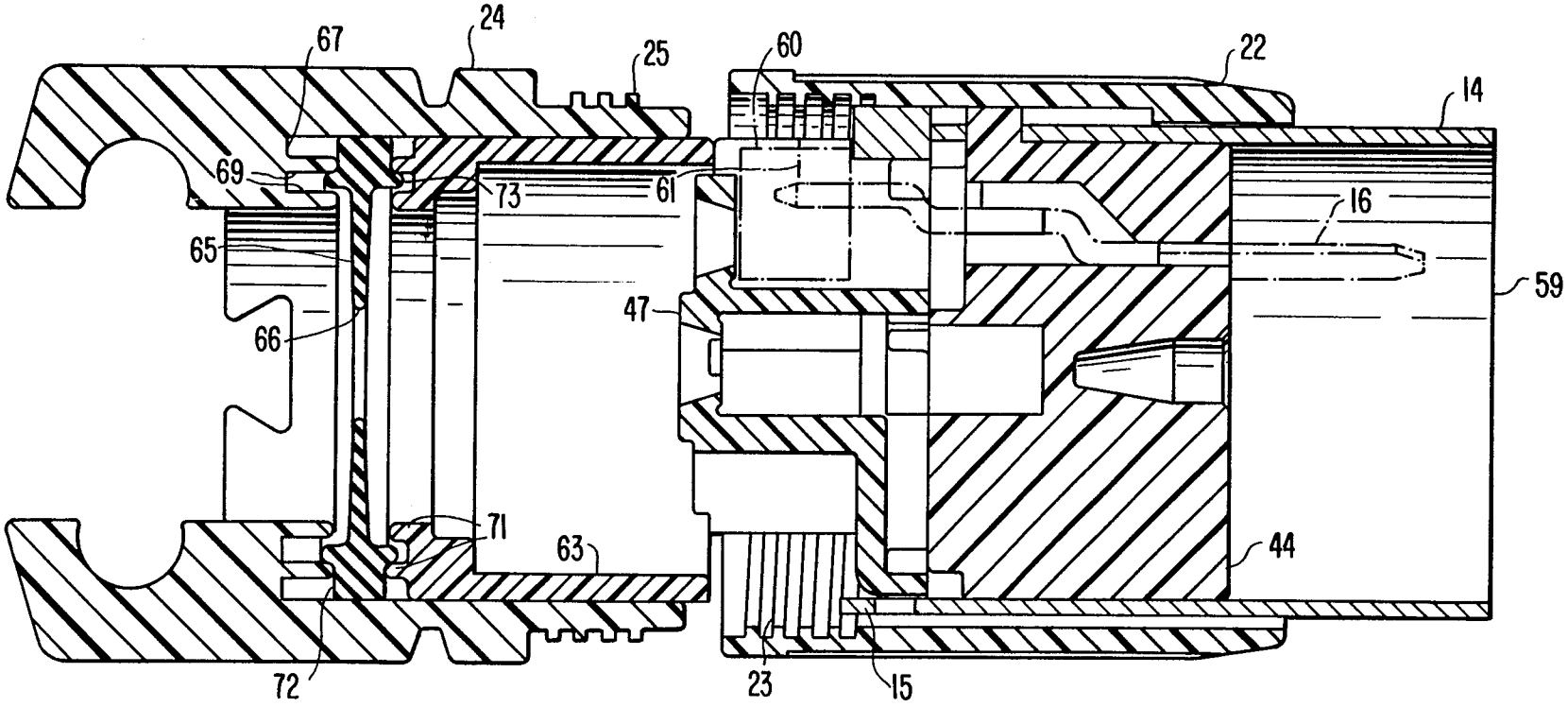
FIG. 22 is a side elevation in longitudinal section, of the partially assembled plug half of a connector in accordance with the present invention.
Figure 23:
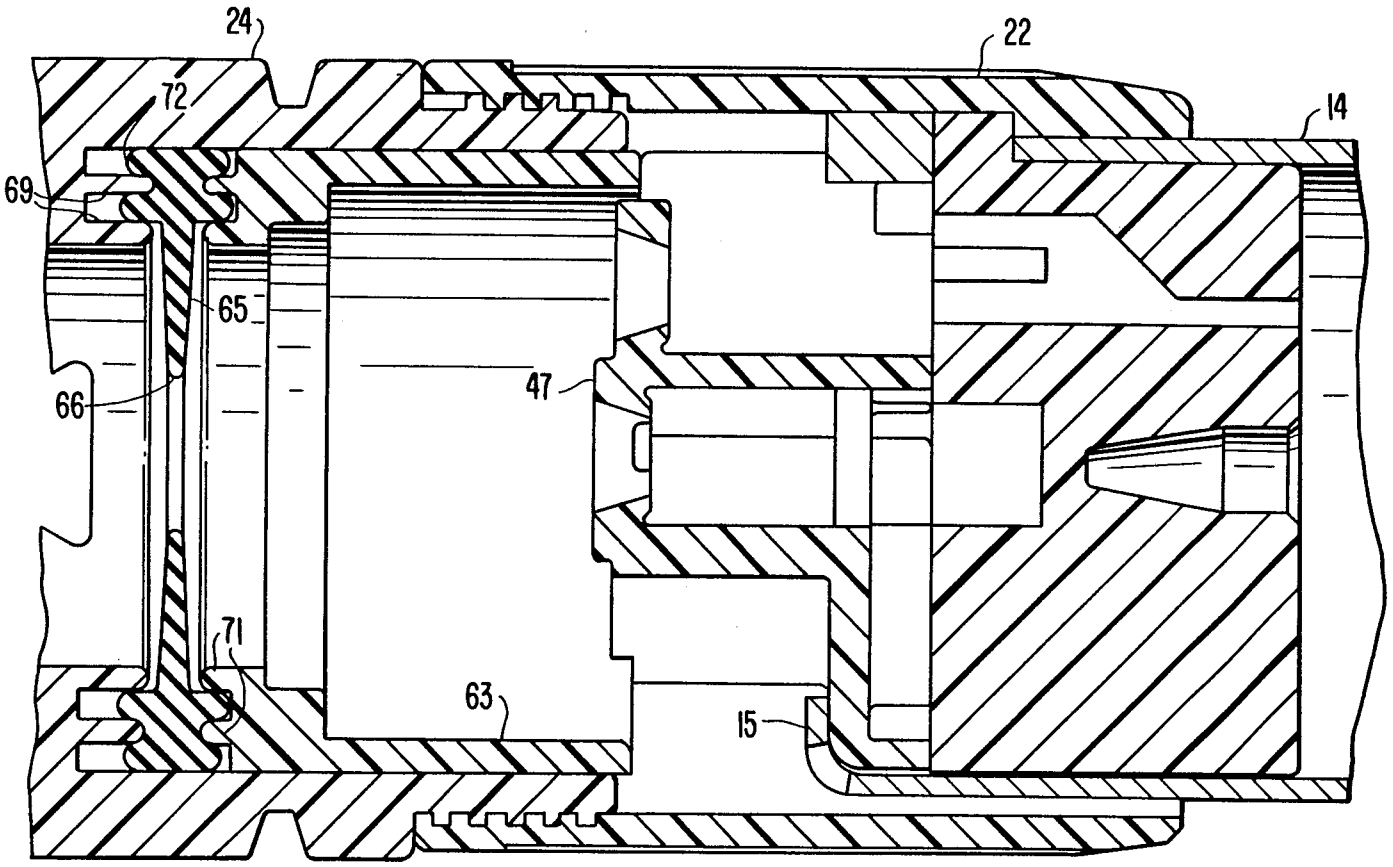
FIG. 23 is a side elevation similar to FIG. 2 showing the plug half of the connector fully assembled.

FIGS. 22 and 23 show the plug half 10 of a connector in accordance with the invention incorporating the components and characteristics discussed above. In FIG. 22, the components are not yet fully assembled and in FIG. 23 they are in a fully assembled condition. Sleeve 14 has an open end 59 to receive the barrel of the receptacle, the sleeve surrounding blades such as blade 16, shown in phantom lines, which are held in and protrude from both ends of blade holder 44. Blade holder 44 is received in the other end of sleeve 14 from open end 59, along with contact holder 47. The contact holder, shown separately in FIGS. 24 and 25, receives either three or four box terminals 60, depending upon whether the unit is designed for three-wire or four-wire use, each box terminal being dimensioned to receive the rear end of a blade and the stripped end of a wire to mechanically and electrically interconnect the wire with the blade. Each box terminal has a set screw 61 which can be tightened to press the wire and blade end together within the box terminal. Front housing 22 with its internal threads 23 surrounds sleeve 14 as well as the blade holder and contact holder bodies.

The rear portion of the assembly includes the rear housing 24 having external threads 25. Within the rear housing is a cup 63 which is slidably received within the rear housing and an elastomeric seal 65 having a central opening 66 through which can pass a cable, not shown, having wires for connection to the blades.

Within rear housing 24 is a forwardly facing shoulder 67 on which is formed annular ribs 69 which protrude toward cup 63. Similarly, on the rear end of cup 63 are rearwardly extending annular ribs 71. Ribs 69 and 71 are substantially aligned with each other. Seal 65 includes a thickened annular edge portion 72 which is dimensioned to be received within housing 24 and oppositely extending annular ribs 72 and 73 which lie between ribs 69 and 71, respectively.

As seen in FIG. 22, when the elements are in contact with each other but are in a relaxed state, the forward end of cup 63 protrudes beyond the forward end of housing 24 and the thickened portion 72 of seal 65 is essentially uncompressed. However, when threads 23 of front housing 22 are fully engaged with threads 25 of the rear housing cup 63 presses against rear surfaces of contact holder 47, pressing the contact holder against the blade holder and also pressing the cup 63 rearwardly so that the thickened portion 72 of seal 65 is compressed between the sets of annular ribs 69 and 71, creating a strong seal and concurrently providing an elastic force to maintain the components within the connector in solid engagement with each other, as shown in FIG. 23.

At the rear end of sleeve 14 are three axially projecting tabs 15. After the blade holder and contact holder bodies have been inserted into the rear end of the sleeve, tabs 15 are bent over a rearwardly facing surface of contact holder 47 to retain the contact holder and blade holder bodies within the sleeve, the key members being fully seated in the notches in this position.

Figure 24:
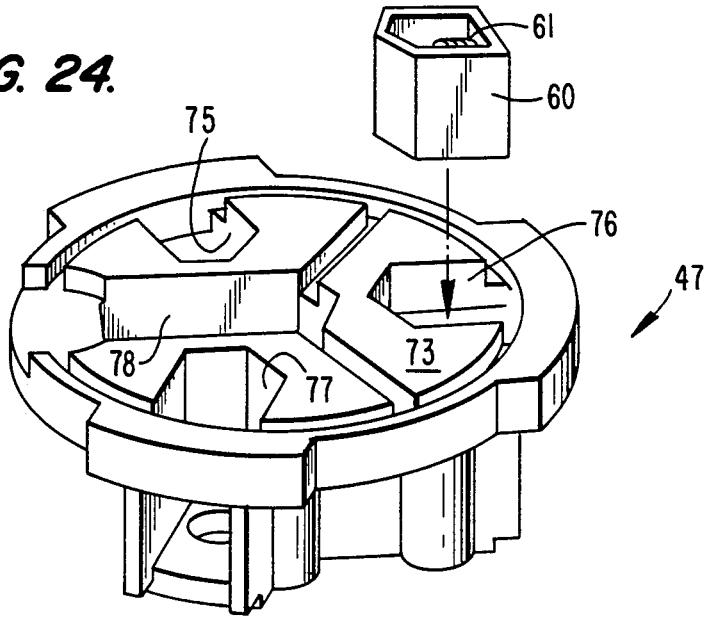
FIGS. 24 and 25 are front and rear perspective views, respectively, of a contact holder usable in the connector of FIG. 1.
Figure 25:
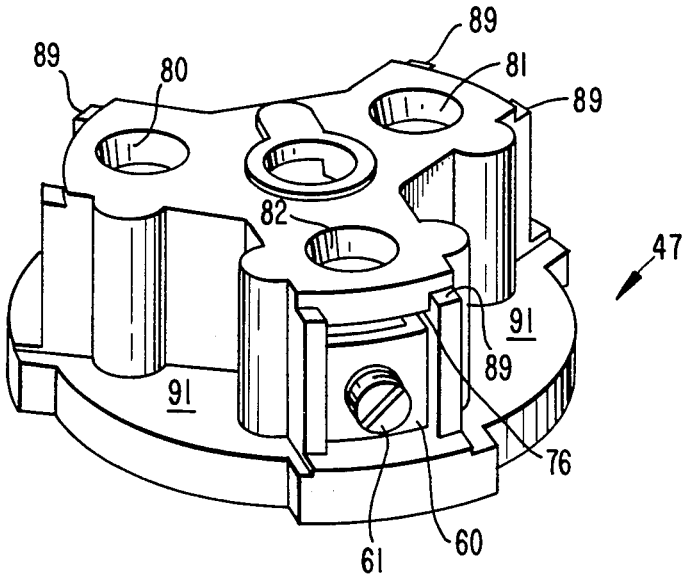

FIGS. 23 and 24 show a contact holder apart from the remainder of the assembly. The front surface of the contact holder 47, which abuts the rear surface of the blade holder is the surface 73 seen in FIG. 24. Openings 75, 76, 77 and 78 extend inwardly from surface 73 and are shaped to receive box terminals 60, one of which is shown in a position to be inserted into the opening 76. As seen in FIG. 25, openings 75–77 extend through the body of the contact holder and open radially outwardly to provide access to the slotted end of sets screws 61. A similar opening is provided for the box terminal in opening 78. The rear surface of contact holder 47 is penetrated by holes 80, 81 and 82 through which the stripped ends of wires can be inserted. As will be recognized in FIG. 22, when the contact holder with its installed box terminals is inserted into sleeve 14, the rear ends of the blades enter the box terminals from the front. The wires can then be inserted from the rear through openings 80–82 and the set screws tightened to clamp the wires and blades together.

The contact holder also has shoulders 89 against which the forward edge of cup 63 presses when the plug is assembled. After the blade holder and contact holder are installed in sleeve 14 the tabs 15 are bent over, as described above, and bear against surfaces 91, seen in FIG. 25.

Figure 26:
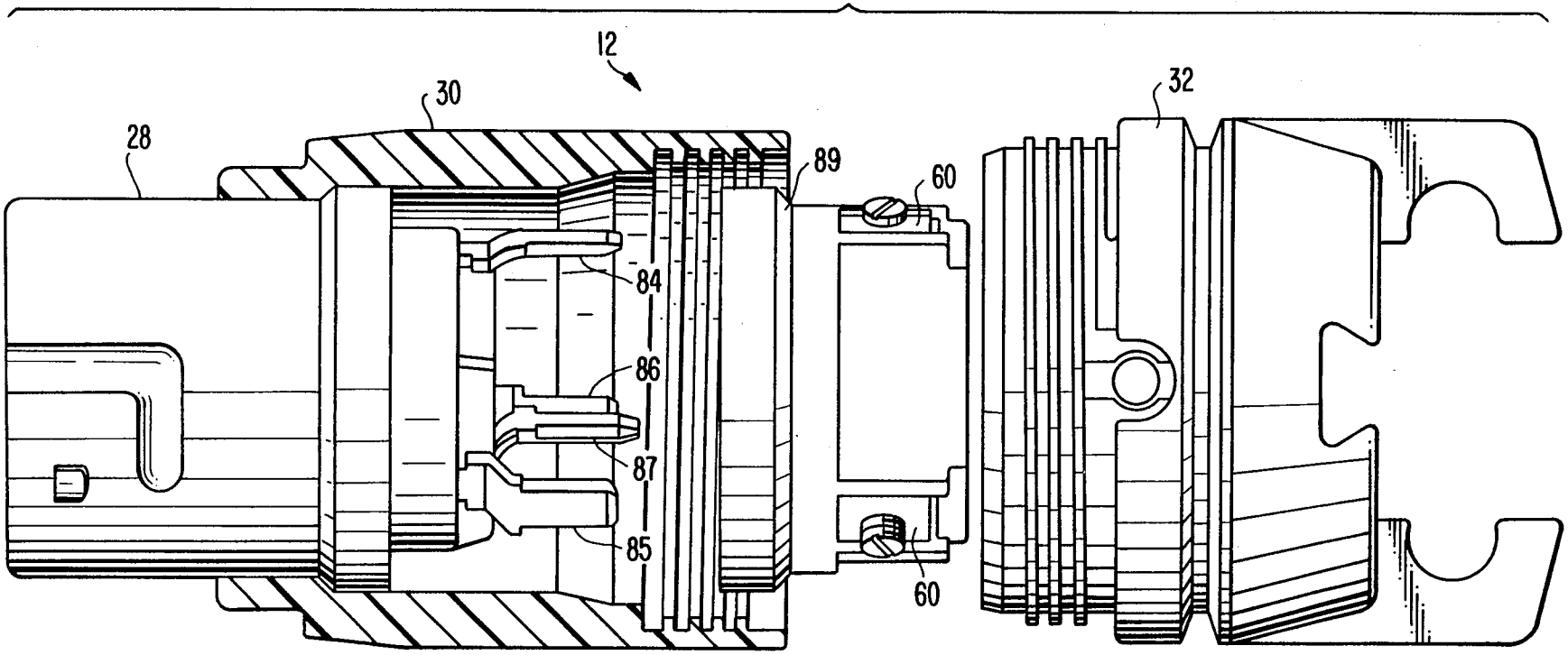
FIG. 26 is a partially exploded side elevation of the female (receptacle) half of the connector of FIG. 1.

FIG. 26 is a sectional view, partly exploded, of the receptacle portion of the connector. As seen therein, the barrel 28 also constitutes a holding body for electrical contacts to receive the forward ends of the blades in the plug, the contacts having exposed blade ends 84, 85, 86 and 87 for connection to wires in the receptacle portion. The rear portion of the barrel body is surrounded by front housing 30 which also, in the assembled condition, surrounds a contact holder 89 which is identical to contact holder 47 and carries box terminals 60 as in the plug portion. The rea housing 32 of the receptacle half is the same as rear housing 24 of the plug half.

While certain advantageous embodiments have been chosen to illustrate the invention, it will be understood by those skilled in the art that various changes and modifications can be made therein without departing from the scope of the invention as defined in the appended claims.

What is claimed is:

1. An electrical connector of the type having a male half and a female half which are joinable, the male half having a plurality of axially protruding blades at least partially enclosed by a sleeve and the female half having a barrel receivable in one end of the sleeve with a plurality of openings with contact means positioned to receive the blades, the improvement wherein the male half comprises a blade holding body of insulating material receivable in the other end of said sleeve, radially protruding key members of selected width and in selected angular positions, said plurality of blades extending through said blade holding body and protruding from opposite ends thereof;

a contact holding body receivable in said other end of said sleeve adjacent said blade holding body and having contact means therein for connecting wires entering said connector to one end of each of said blades, said contact holding body having a plurality of radially protruding key members of selected width and in selected angular positions, said sleeve including a tubular cylindrical body for receiving said barrel at one end during joining of the connector halves and for receiving one each of said blade and contact holding bodies at the other end, and means defining a plurality of notches extending axially into said sleeve from said other end, said notches being angularly positioned and dimensioned to receive the key members of only those blade and contact holding bodies having key members in selected predetermined positions for preventing relative rotation between said sleeve and either of said blade holding and contact holding bodies, thereby permitting assembly into a connector of only those connector components having corresponding electrical characteristics.

2. A connector according to claim 1 wherein the outer surface of said barrel includes at least one L-shaped groove extending axially and then circularly from the distal end thereof, and said sleeve includes at least one inwardly extending bulge shaped protrusion to engage said recess only when said sleeve and barrel are joined in one specific angular orientation.

3. A connector according to claim 1 wherein each said sleeve includes a plurality of external bumps and said connector further includes a front housing comprising a tubular body of insulating material dimensioned to closely surround said sleeve and having an inner surface with means defining axial grooves angularly located to receive said bumps when said tubular body is axially passed over said sleeve in only one angular orientation relative to said sleeve, said tubular body further including means defining internal threads at on end thereof.

4. A connector according to claim 3 and further including a rear housing having external threads at the front thereof engageable with said threads on said front housing and means defining a passage for electrical conductors from the rear end of said housing to said contact holding body.

5. A connector according to claim 1 wherein said blade holding body includes a generally cylindrical body of insulating material having passages therethrough shaped to receive electrically conductive blades, said body having three radially protruding key members each of which encompasses a radial line separated by 120° from lines passing through the other two key members.

6. A connector according to claim 5 wherein the axial thickness of each key member on each blade-holding body added to the axial thickness of each key member on each contact-holding body is substantially equal to the axial depth of a notch so that said notch can respectively receive key members on a blade holding body and a contact holding body together.

7. A connector according to claim 6 wherein the portion of the notch to receive the key member on a contact holding body is wider than the portion to receive the key member on a blade holding body.

8. A connector according to claim 7 wherein said wider notch portion is centered on the narrower notch portion.

9. A plurality of components for making connectors of a plurality of classes, each class constituting connectors having predetermined electrical characteristics different from each other class, each connector being of the type having a male half and a female half which are joinable to electrically interconnect conductive members in the halves, the male half having a plurality of axially protruding blades at least partially enclosed by a sleeve and the female half having a barrel receivable in one end of the sleeve with a plurality of openings with contact means positioned to receive the blades, the components comprising a plurality of blade holding bodies of insulating material, each blade holding body including a plurality of radially protruding key members each having a width and an angular position selected from a predetermined number of sets of widths and angular positions, the combination of sets on each body being unique to a class of connectors, said plurality of blades extending through said blade holding body and protruding from opposite ends thereof;

a plurality of contact holding bodies each having contact means therein for connecting wires entering said connector to one end of each of said blades, each said contact holding body having a plurality of radially protruding key members each having width and an angular position selected from a predetermined number of sets of widths and angular positions, the combination of sets on each body being unique to a class of connectors, a plurality of sleeves, each said sleeve including a tubular, cylindrical body for receiving said barrel at one end during joining of the connector halves and for receiving and retaining one each of said blade and contact holding bodies at the other end, means defining a plurality of notches extending axially into said sleeve from said other end, said notches being angularly positioned and dimensioned to receive blade and contact holding bodies having key members in unique combinations of sets of positions and widths so that said bodies and sleeves can be assembled to form a plurality of connectors each of which has the proper components for a predetermined connector class.

10. A claim according to claim 9 wherein said plurality of blade holding bodies includes a plurality of groups of bodies, each member of a group having key members with a set of widths and angular positions different from each member of every other group, each member of a group having electrical characteristics suitable for at least one selected connector class.

11. A method of forming components for making connectors of a plurality of connector classes, each class including connectors having predetermined electrical characteristics different from each other class, each connector being of the type having a male half and a female half which are joinable to electrically interconnect conductive members in the halves, the male half having a plurality of axially protruding blades at least partially enclosed by a sleeve and the female half having a barrel receivable in one end of the sleeve with a plurality of openings with contact means positioned to receive the blades, the method comprising forming a plurality of blade holding bodies of insulating material, in which each blade holding body includes a plurality of radially protruding key members each having a width and an angular position selected from a predetermined number of sets of widths and angular positions, the combination of sets on each body being unique to a class of connectors, and a plurality of blades extending through the blade holding body and protruding from opposite ends thereof;

forming a plurality of contact holding bodies each having contact means therein for connecting wires entering said connector to one end of each of the blades, each contact holding body having a plurality of radially protruding key members each having a width and an angular position selected from a predetermined number of sets of widths and angular positions, the combination of sets on each body being unique to a class of connectors, forming a plurality of sleeves, each sleeve including a tubular, cylindrical body for receiving a barrel at one end during joining of the connector halves and for receiving and retaining one each of the blade and contact holding bodies at the other end, each sleeve being formed with a plurality of notches extending axially into the sleeve from the other end, the notches in each sleeve being angularly positioned and dimensioned to receive blade and contact holding bodies having key members in a unique combination of sets of positions and widths so that the bodies and sleeves can be assembled to form a plurality of connectors each of which has the proper components for a predetermined connector class.

* * * * *